United States Patent [19]

Buscher

[11] Patent Number: 4,922,964

[45] Date of Patent: May 8, 1990

[54] SERVOVALVE CONSTRUCTION

[75] Inventor: John H. Buscher, East Amherst, N.Y.

[73] Assignee: HSC Controls Inc., Buffalo, N.Y.

[21] Appl. No.: 281,339

[22] Filed: Dec. 8, 1988

[51] Int. Cl.[5] ..... F15B 13/043

[52] U.S. Cl. ..... 137/625.62; 137/625.61

[58] Field of Search ..... 137/625.62, 625.61

[56] References Cited

U.S. PATENT DOCUMENTS

| | | | |
|---|---|---|---|
| 2,532,568 | 12/1950 | Myers . | |
| 2,977,985 | 4/1961 | Ericson et al. | 137/625.61 |
| 3,029,830 | 4/1962 | Klover et al. | 137/625.62 X |
| 3,312,353 | 4/1967 | Rosaen | 210/453 |
| 3,473,562 | 10/1969 | Ellison | 137/549 |
| 3,698,437 | 10/1972 | Cox | 137/625.62 |
| 4,169,489 | 10/1979 | Inada et al. | 137/545 |

*Primary Examiner*—Gerald A. Michalsky
*Attorney, Agent, or Firm*—Joseph P. Gastel

[57] ABSTRACT

A hydraulic servovalve including a torque motor and a valve housing containing a fluid inlet conduit in communication with a spool chamber, a spool within the spool chamber, a filter chamber within the spool, a filter within the filter chamber dividing the spool chamber into a first filter chamber section in communication with the fluid inlet conduit and a second filter chamber section on the opposite side of the filter from the first filter chamber section, a conduit within the housing for effecting communication between the second filter chamber section and nozzles associated with a flapper coupled to the torque motor, and the first filter chamber section being in communication with a fluid outlet in the valve housing. Also the spool can preferably have a notch therein for effecting direct communication between the fluid inlet and the fluid outlet in addition to the communication which is effected therebetween through the first filter chamber section of the filter chamber.

6 Claims, 6 Drawing Sheets

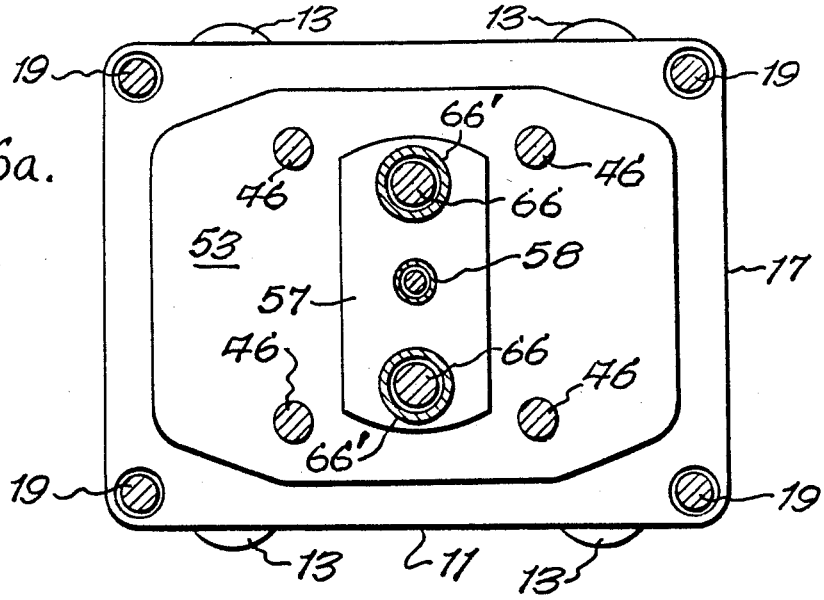
Fig. 6a.
Fig. 6b.
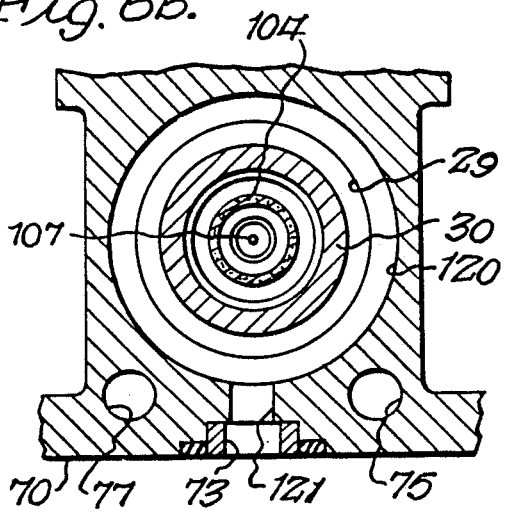
Fig. 6c.
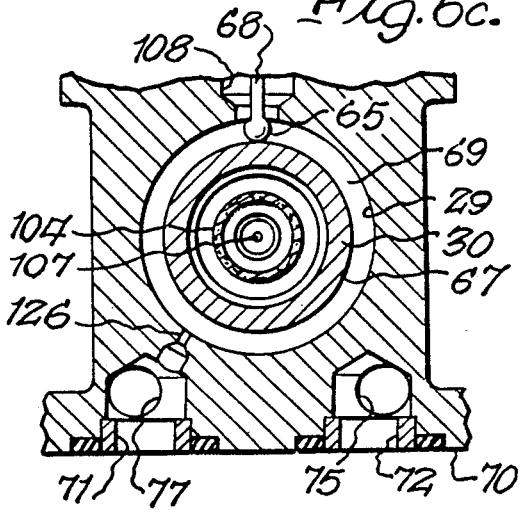
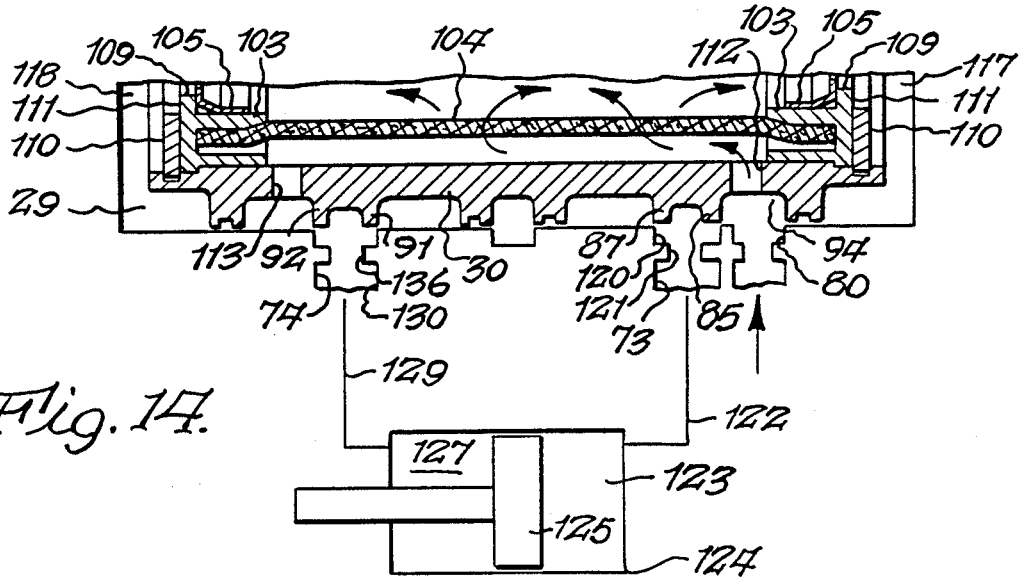
Fig. 14.

SERVOVALVE CONSTRUCTION

BACKGROUND OF THE INVENTION

The present invention relates to an improved hydraulic servovalve.

By way of background, hydraulic servovalves are well known. They generally include a torque motor and a valve assembly. The valve structure is located in a valve housing which conventionally has three bores therein. One bore is for the spool, a second bore is for the nozzle structure, and a third bore is for the filter. The fact that there are three bores in the valve housing produces certain inherent disadvantages. First of all, the valve housing has to be relatively large to accommodate the three bores and their associated structure. In addition, fluid conduits are required in the valve housing between all three bores, and this often requires complex machine operations and also sometimes requires a spool bushing, especially when the spool itself is of very small diameter in a high pressure system.

Filters cannot be eliminated when the fluid, such as aviation fuel, which passes through the valve, is relatively unclean so that it clogs the orifices of the nozzles. In addition, since aviation fuel systems for aircraft operate at a relatively low pressure, the spools have to be of relatively large size in order to be subjected to sufficiently large forces for moving them. The combination of a relatively large spool and the necessity for the separate filter bore, of conventional valves, causes the entire servovalve to be of relatively large size and weight which is undesirable, especially for aircraft fuel control applications.

SUMMARY OF THE INVENTION

It is accordingly one object of the present invention to provide an improved servovalve which is much lighter and smaller than servovalves of equal capacity, while retaining the ability to filter fluid passing therethrough without utilizing a filter bore in the valve housing.

It is another object of the present invention to provide an improved servovalve which contains both a relatively large spool and also a filter and yet is of smaller size and weight than servovalves of equal capacity having a separate filter bore in the valve housing.

Another object of the present invention is to provide an improved servovalve in which both the filter and a fluid path to the fluid outlet in the valve housing are located within the spool, thereby not only eliminating the need for a filter bore in the valve housing but also providing an additional fluid path through the valve which can result in increased fluid flow through the valve.

A further object of the present invention is to provide an improved servovalve which contains a fluid filter and yet has fewer ducts within the valve housing in view of the fact that the filter bore has been eliminated.

Still another object of the present invention is to provide an improved servovalve in which flow to the outlet need not be through a complex series of bores in the valve housing but can be through a single bore in communication directly with the spool chamber in view of the fact that the required fluid flow for proper operation can be through a spool bore which also houses a filter. Other objects and attendant advantages of the present invention will readily be perceived hereafter.

The present invention relates to a servovalve comprising a housing, motor means in said housing, a flapper coupled to said motor means, nozzle means located proximate said flapper, a spool chamber in said housing, a spool in said spool chamber, fluid inlet conduit means in said valve housing in communication with said spool chamber, fluid outlet conduit means in said valve housing in communication with said spool chamber, a filter chamber in said spool, filter means in said filter chamber, a first filter chamber section in said filter chamber, a second filter chamber section on the opposite side of said filter means from said first filter chamber section to receive fluid from said first filter chamber section, first conduit means in said spool for effecting communication between said fluid inlet conduit means and said first filter chamber section, second conduit means in said housing for effecting communication between said second filter chamber section and said nozzle means, and third conduit means in said spool for effecting communication between said first filter chamber section and said fluid outlet conduit means.

The present invention also relates to a spool-filter combination for a servovalve comprising an elongated tubular spool having an inner surface and an outer surface, a chamber within said inner surface, filter means in said chamber, a first filter chamber section in said chamber, and a second filter chamber section in said chamber on the opposite side of said filter means from said first filter chamber section, first bore means extending between said outer surface and said inner surface for conducting fluid into said chamber, and second bore means extending between said outer surface and said inner surface for conducting fluid out of said chamber.

The various aspects of the present invention will be more fully understood when the following portions of the specification are read in conjunction with the accompanying drawings wherein:

BRIEF DESCRIPTION OF THE DRAWINGS

FIG. 6 is an enlarged fragmentary cross sectional view taken substantially along line 6—6 of FIG. 4 and showing various internal parts and conduits of the valve;

Figure 1:
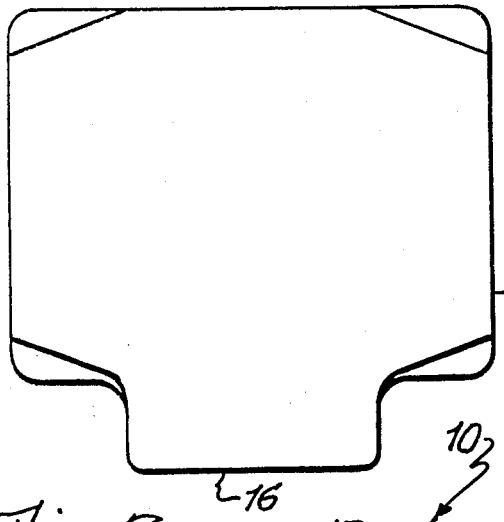
FIG. 1 is a top plan view of the improved servovalve of the present invention.
Figure 2:
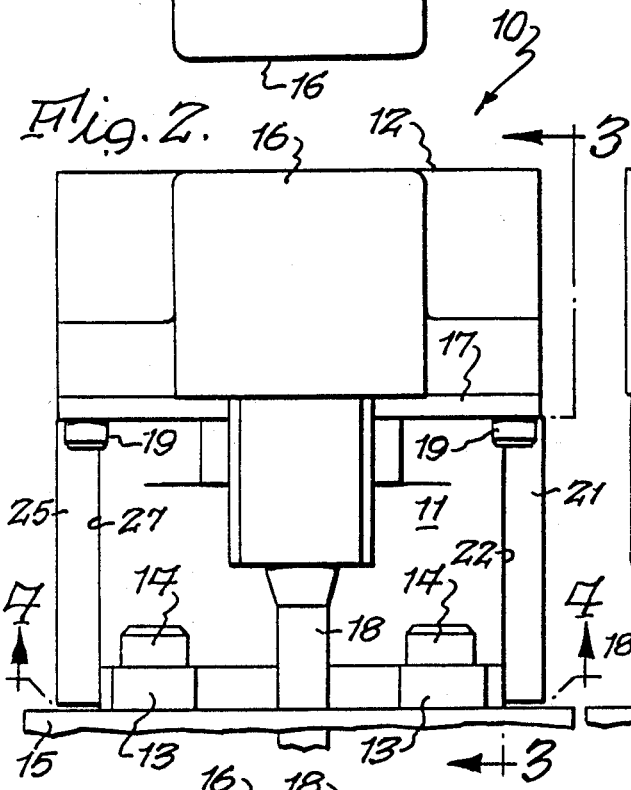
FIG. 2 is a side elevational view of the valve of FIG. 1 and showing fragmentarily the unit on which it is mounted.
Figure 3:
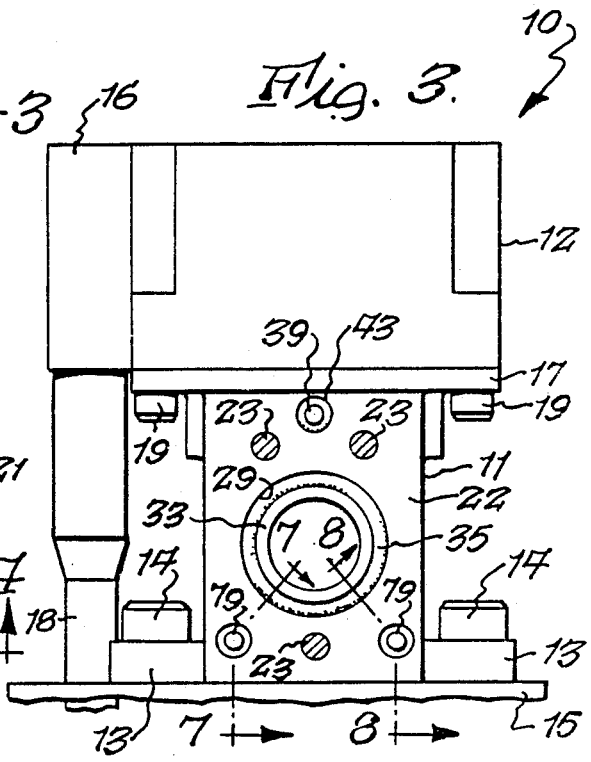
FIG. 3 is a fragmentary cross sectional view taken substantially along line 3—3 of FIG. 2.
Figure 4:
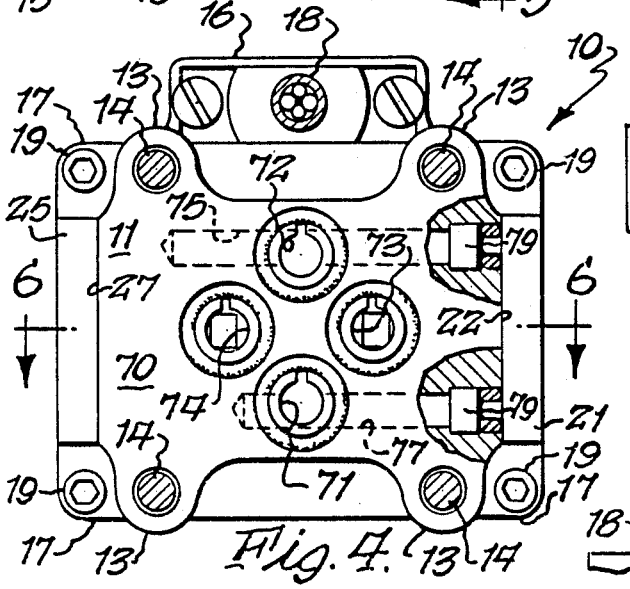
FIG. 4 is a cross sectional view taken substantially along line 4—4 of FIG. 2.
Figure 7:
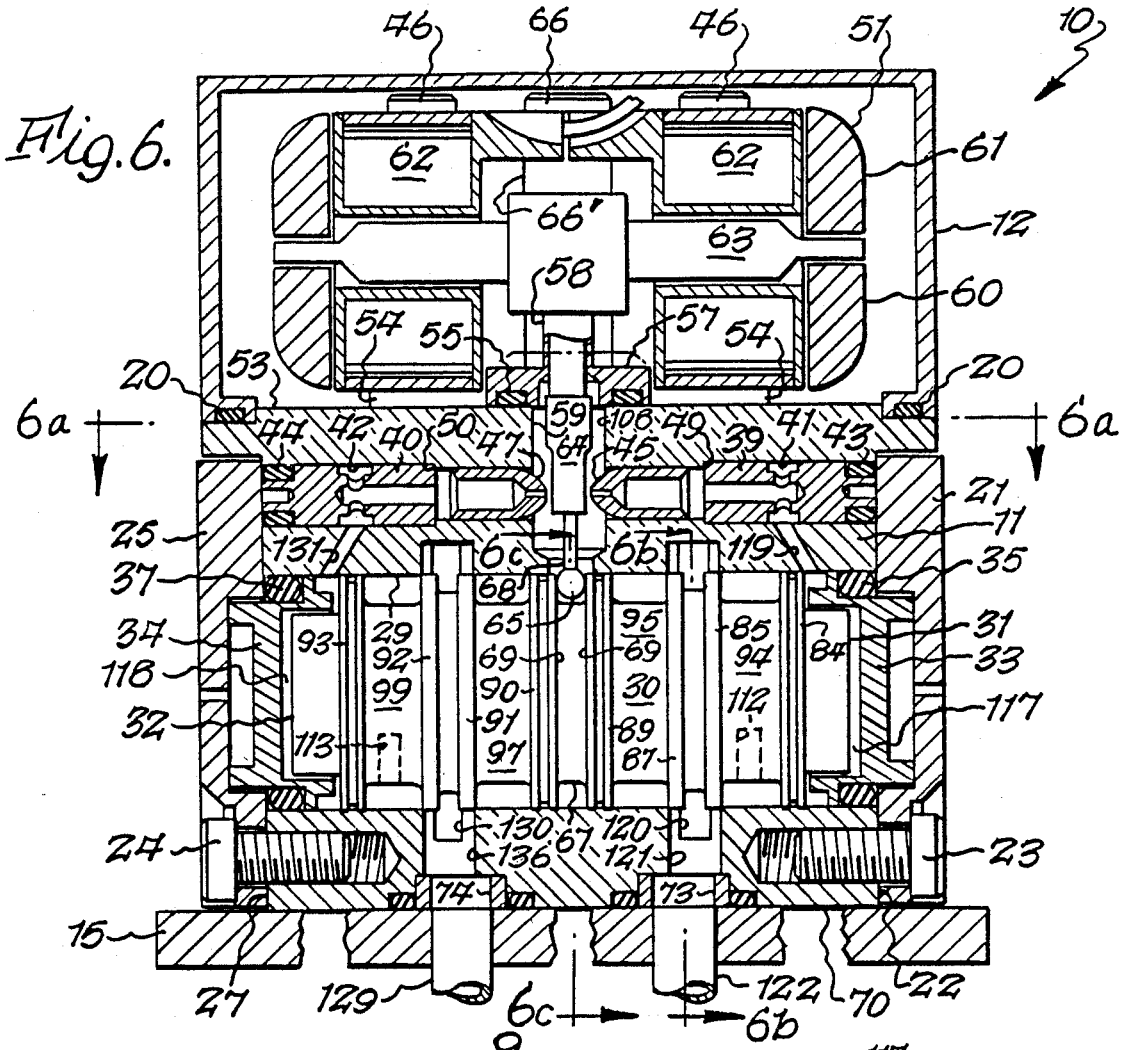
Figure 7:
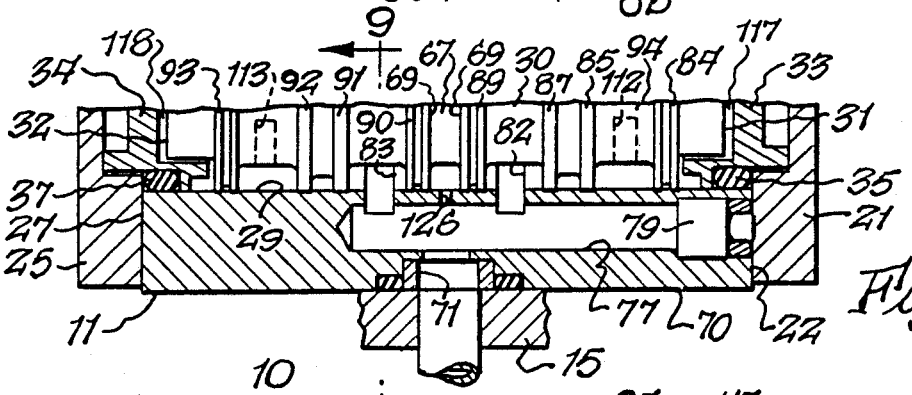
Figure 8:
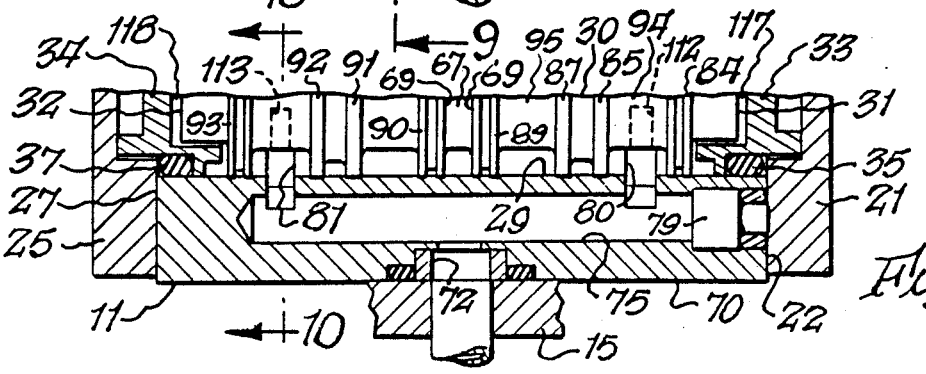
Figure 9:
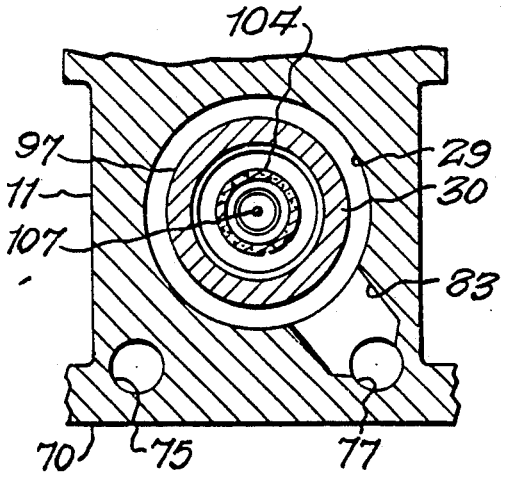
Figure 10:
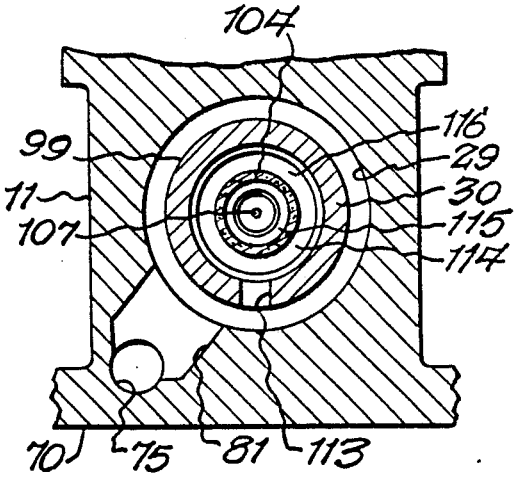
Figure 11:
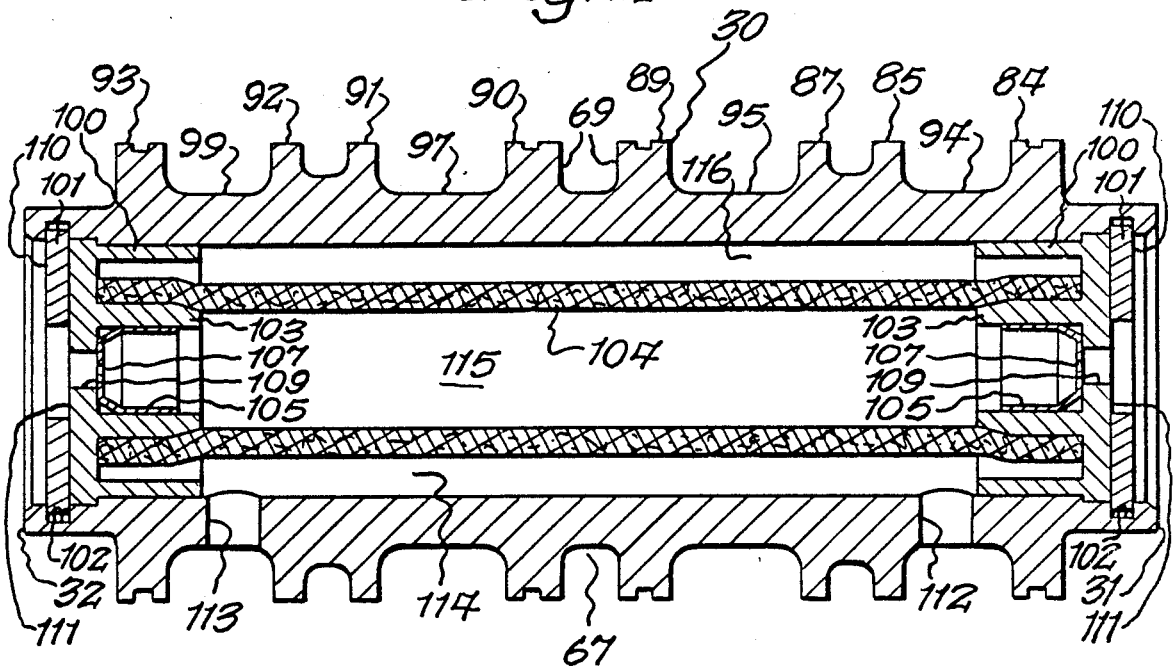
Figure 12:
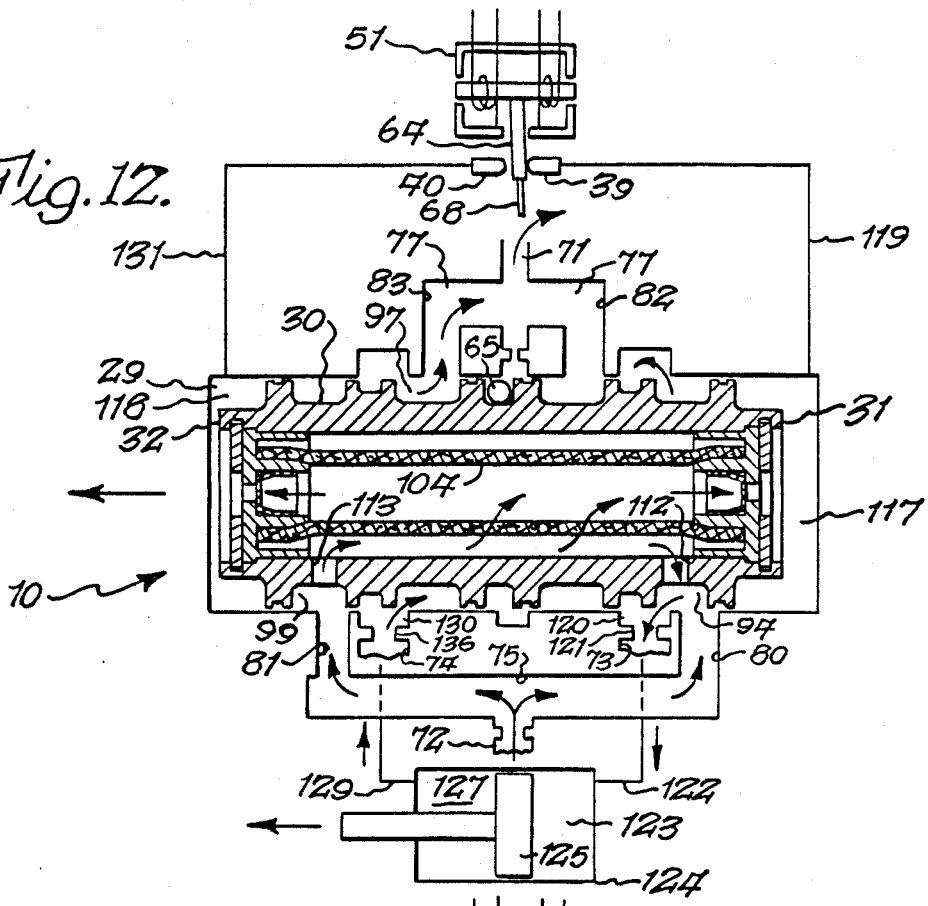
Figure 13:
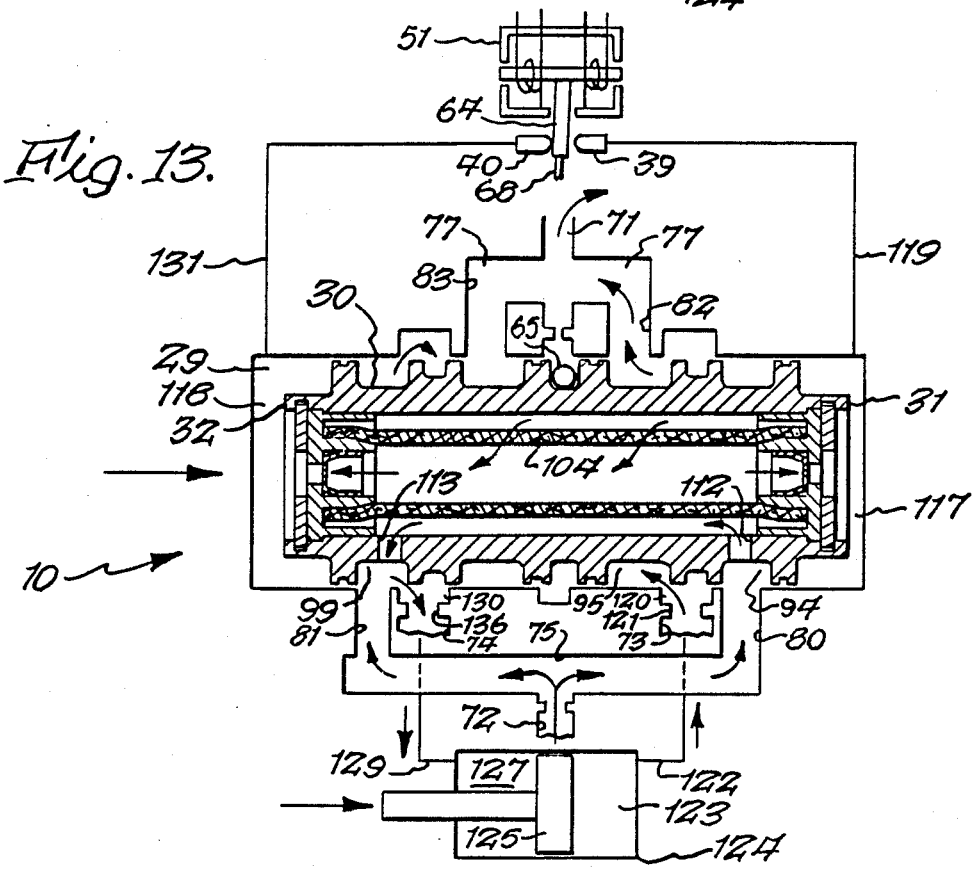
Figure 15:
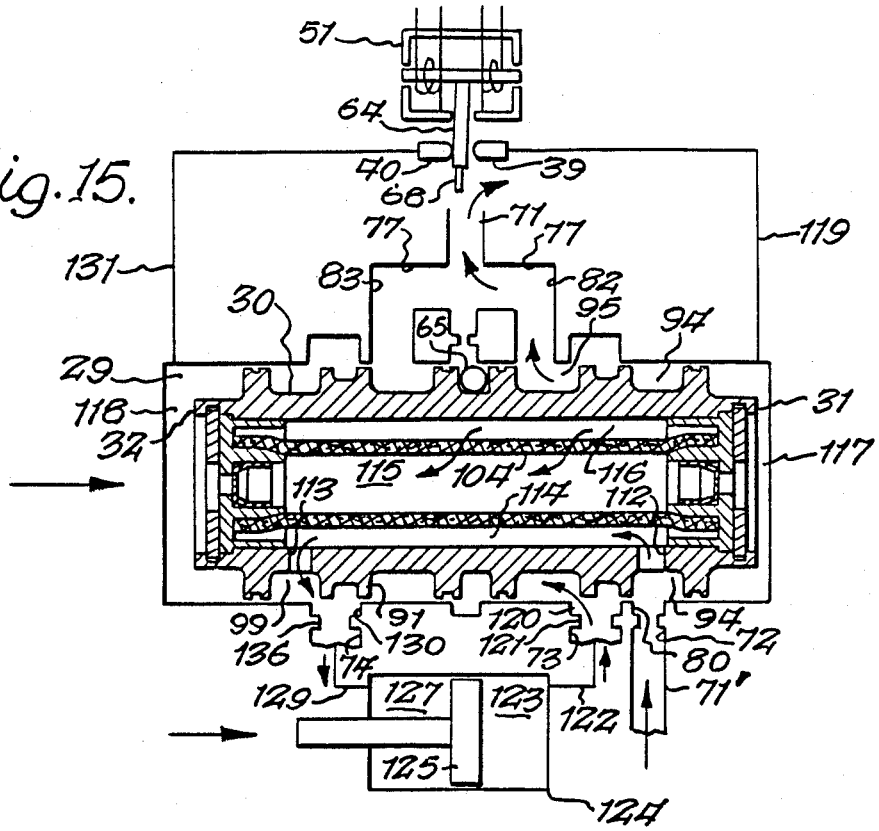
Figure 16:
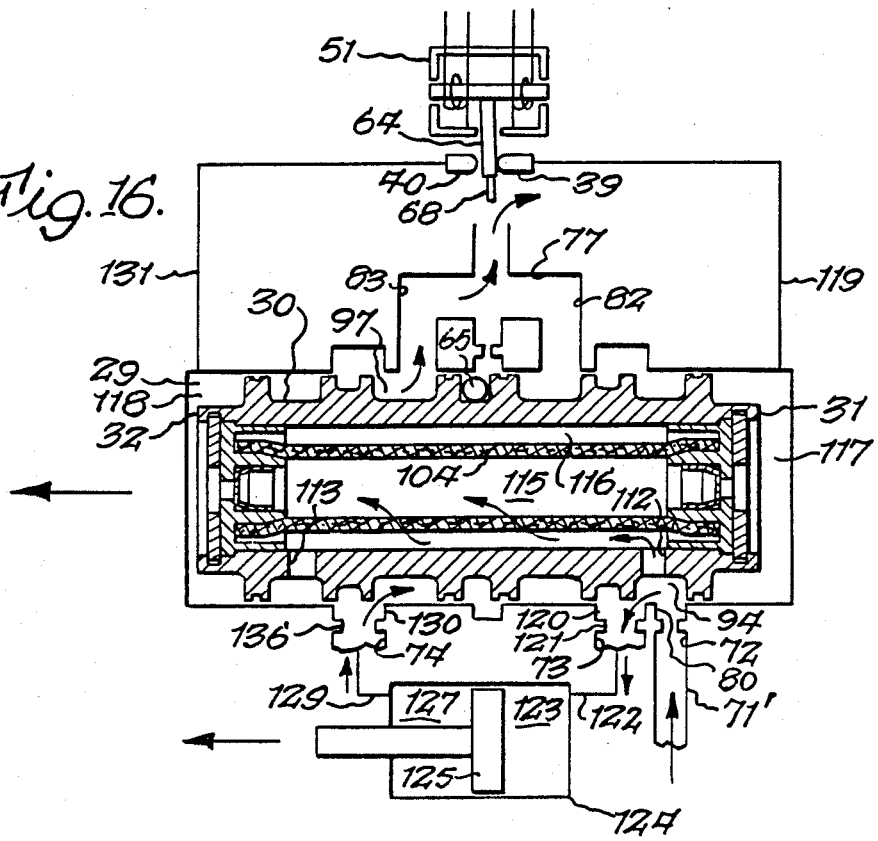

FIG. **6*a* is a cross sectional view taken substantially along line 6*a*—6*a* of FIG. 6**;

FIG. **6*b* is a cross sectional view taken substantially along line 6*b*—6*b* of FIG. 6**;

FIG. **6*c* is a cross sectional view taken substantially along line 6*c*—6*c* of FIG. 6**;

FIG. 7 is an enlarged fragmentary cross sectional view taken substantially along line 7—7 of FIG. 3 and showing the return conduit and associated porting within the valve housing;

FIG. 8 is an enlarged fragmentary cross sectional view taken substantially along line 8—8 of FIG. 3 and showing the supply conduit and associated porting within the valve housing;

FIG. 9 is a fragmentary cross sectional view taken substantially along line 9—9 of FIG. 7;

FIG. 10 is a fragmentary cross sectional view taken substantially along line 10—10 of FIG. 8;

FIG. 11 is an enlarged cross sectional view of the combined spool and filter;

FIG. 12 is a schematic view of the structure of FIGS. 1–11 with the flapper and the spool in positions wherein the spool is shifted to the left;

FIG. 13 is a schematic view similer to FIG. 12 but showing the various parts in the position wherein the spool is shifted to the right;

FIG. 14 is a fragmentary schematic view of an alternate embodiment wherein there is only one fluid inlet conduit in the valve housing and showing the spool in a centered position;

FIG. 15 is a view similar to FIG. 14 but showing the spool shifted to the right; and FIG. 16 is a view similar to FIG. 14 but showing the parts in a position wherein the spool is shifted to the left.

DESCRIPTION OF THE PREFERRED EMBODIMENTS

Figure 5:
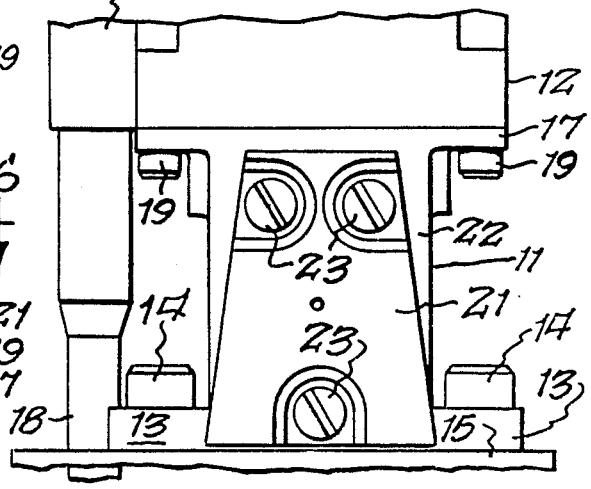
FIG. 5 is a fragmentary side elevational view showing the cover plate mounted on the side of the valve shown in FIG. 3.

The servovalve 10 includes a spool housing 11 having a torque motor housing 12 mounted thereon. Spool housing 11 is fabricated out of a block of metal and it includes lobes 13 (FIGS. 2–6) at its lower end which receive screws 14 for attaching the servovalve 10 to an associated plate 15 of an external device having conduits associated therewith leading to a unit, such as a fluid motor, which is to be controlled. A flange 17 is formed at the upper end of spool block 11. A plurality of screws 19 extend upwardly through flange 17 and are received in suitable bosses (not shown) in torque motor housing 12 to retain it in assembled relationship with spool housing 11 with O-ring 20 therebetween. An end plate 21 is secured to end 22 of spool housing 11 by a plurality of screws 23 (FIG. 5). A plurality of screws, such as 24 (FIG. 6), secure end plate 25, which is identical to end plate 21, to end 27 of spool housing 11. A housing portion 16 contains wires from electrical lead 18 for actuating torque motor 51.

A bore 29 in spool housing 11 receives spool 30 which has its ends 31 and 32 spaced from spool plugs 33 and 34, respectively, which are retained in bore 29 by end plates 21 and 25, respectively. O-rings 35 and 37 provide seals between spool plugs 33 and 34, respectively, and bore 29.

Nozzles 39 and 40 are positioned in nozzle bores 41 and 42, respectively, of spool housing 11. O-rings 43 and 44 provide seals with bores 41 and 42, respectively. Nozzles 39 and 40 are retained in position by end plates 21 and 25, respectively, and the positions of the outlet tips 45 and 47 of the nozzles is determined by annular shoulders 49 and 50, respectively.

Torque motor 51 is suitably secured within torque motor housing 12 by being fastened by screws 46 to the top surface 53 of spool housing 11 with shims 54 therebetween. Torque motor 51 includes a lower frame 60 and an upper frame 61 around which coils 62 are wound. An armature 63 is suitably secured to tube 58 which is mounted on plate 57 which is attached to surface 53 by screws 66 which extend through spacers 66'. An O-ring 55 provides a seal between plate 57 and the top surface 53 of the spool housing to prevent leakage from bore 59. Armature 63 is thus supported within coils 62 and frames 60 and 61, as shown, and a flapper 64 depends downwardly from armature 63. A feedback spring 68 is associated with flapper 64 in the conventional manner, and the lowermost end of feedback spring 68 has a ball 65 mounted thereon which is received in the groove or notch 67 between land surfaces 69 of spool 30.

A plurality of bores or ports are formed in the bottom wall 70 of spool housing 11. Bore 72 (FIGS. 4 and 8) is a fluid supply bore, and bore 71 (FIGS. 4 and 7) is a fluid return bore. Bores 73 and 74 are control bores. O-rings (not numbered) are suitably located in counterbores associated with the foregoing bores to provide sealing engagement with plate 15. Bore 73 is in communication with bore 121 which is in communication with annular groove 120 (FIG. 6*b*). Bore 74 is in communication with bore 136 which is in communication with annular conduit 130 (FIG. 6), which is like annular conduit 120. Supply bore 72 is in communication with bore 75 (FIGS. 3, 8 and 10). Return bore 71 is in communication with bore 77 (FIGS. 3, 7 and 9). Plugs 79 and associated O-rings (not numbered) are held in the ends of bores 75 and 77 by end plate 21 to seal the ends of these bores. Channel conduits 80 and 81 (FIGS. 8 and 10) in spool housing 11 effect communication between supply bore 75 and spool chamber 29. Only channel conduit 81 is shown in FIG. 10. However, channel conduit 80 is identical thereto. Channel conduits 82 and 83 effect communication between bore 77 and spool chamber 29 (FIGS. 7 and 9). Channel conduit 82 is identical to channel conduit 83.

The spool 30 (FIGS. 6, 7, 8 and 11) has annular lands 84, 85, 87, 89, 90, 91, 92 and 93 formed thereon. Annular notches or grooves are formed between adjacent lands. Thus, annular grooves or notches 94, 95, 97, 67 and 99 are located on the outer periphery of spool 30. Annular orifice adapters 100 (FIG. 11) of the cross sectional configuration shown are located at the ends of spool chamber 29 and retained therein by snap rings 101 which fit into annular grooves 102. Annular nose portions 103 are formed on the central portions of adapters 100, and the ends of a cylindrical filter 104 are supported on annular noses 103. Orifice members 105 are seated within annular noses 103, and each contains a small central orifice 107 which is in communication with a central opening 109 in each adapter 103. The outer surfaces 110 and 111 are pressure-receiving areas at the end of spool 30. Filter 104 is preferably made of a material known under the trademark POROLOY of Facet Enterprises, Inc., and it is broadly oppositely helically wound superimposed layers of wire which are welded to each other, or it may be fabricated of sintered balls, as is well known, or it may be fabricated of wire mesh.

Bores 112 and 113 effect communication between notches 94 and 99, respectively, and filter chamber 116, which is divided by annular filter 104 into an outer filter chamber section 114 on the outside of filter 104 and an inner filter chamber section 115 within filter 104. It is the placement of the filter 104 within spool 30 which eliminates the necessity for an additional filter bore in the valve housing 11 and which permits the servovalve 10 to be smaller in size and weight than comparable valves which do not have the above-described combined spool and filter construction.

In the schematic diagrams of FIGS. 12 and 13 the mode of operation of the embodiment of FIGS. 1–11 is described. The numerals in FIGS. 12 and 13 correspond to the numerals in FIGS. 1–11. In FIGS. 6–8 the spool 30 and flapper 64 are in a neutral centered position. Therefore, pressurized hydraulic fluid entering supply port or bore 72 (FIG. 8) will enter conduit 75 and conduits 80 and 81. There will be flow from conduit 80 through notch 94 between lands 84 and 85, and then through spool bore 112 into filter chamber 116 (FIG. 11). There will also be flow from supply port 72 through valve bore 75, conduit 81, notch 99 and spool port 113 into filter chamber 116. The high pressure fluid will flow from outer filter section 114 through filter 104 into inner filter section 115. The high pressure fluid will also be in communication with nozzle tips 45 and 47. The communication to nozzle tip 45 is through the right orifice 107 (FIG. 11) and opening 109 in the end of spool 30, space 117 (FIG. 6) at the end of spool chamber 29, port 119 in spool housing 11, and the duct (not numbered) in nozzle 39. The high pressure fluid will also communicate with the tip of nozzle 47 from spool chamber 115 through the left orifice 107, spool chamber portion 118 (FIG. 6) at the left end of spool 30, conduit 131 in spool housing 11, and the ports (not numbered) in nozzle 40. Thus there will be a flow of fluid from the outer ends 45 and 47 of nozzles 39 and 40, respectively. Since flapper 64 is in a neutral centered position between nozzle tips 45 and 47, there will be an equal flow from nozzle tips 45 and 47 and spool 30 will also be centered because there will be equal pressure in end portions 117 and 118 of spool chamber 29. The fluid flowing out of nozzle tips 45 and 47 will pass through bore 108 (FIGS. 6 and 6*c*), through spool notch 67 between land surfaces 69, and through bore 126 (FIGS. 6*c* and 7) into return conduit bore 77.

When it is desired to move piston 125 of fluid motor 123 to the left in FIG. 12, flapper 64 (FIG. 12) is moved to the right toward nozzle 39 by actuation of torque motor 51. Thus the flow of pressurized fluid through nozzle tip 45 will be more restricted and the flow from nozzle tip 47 will be less restricted than when the flapper 64 was in the neutral position. Thus, there will be an increase in pressure in conduit 119 and in the right space 117 of spool chamber 29. There will also be a corresponding decrease in fluid pressure in valve conduit 131 and the left end 118 of spool chamber 29. The pressure differential between chamber ends 117 and 118 will cause spool 30 to shift to the left, and thus there will now be flow from conduit 75 through notch 94, into annular groove 120 in valve housing 11 and into conduit 121 leading to control port 73 from which it flows through conduit 122 to chamber 123 of fluid motor 124 to thereby apply high pressure to the right side of piston 125. There is also a flow of fluid from conduit 75 into conduit 81, through spool notch 99 and spool bore 113, outer filter chamber 114 and through spool bore 112 into spool notch 94 to the conduits leading to motor chamber 123. Thus there are two paths of flow to motor chamber 127. The flow from outer filter chamber section 114 will also pass through filter 104 into filter chamber section 115 from which it passes to the flapper nozzles. Simultaneously, chamber 127 of fluid motor 124 is placed in communication with return port 71 through conduit 129, control port 74, bore 136, annular valve conduit 130, spool notch 97, return conduit 83, return conduit 77 and return port 71. There is also flow of fluid from nozzle tips 45 and 47 in the above-described path through bore 108, spool notch 67 and bore 126 to the return conduit 77. In the foregoing action it is to be especially noted that any flow to flapper nozzles 39 and 40 must flow through filter 104. During the foregoing movement of spool 30, feedback spring 68 will be flexed to exert a torque on the flapper 64 and armature 63 in the conventional manner to thus return the flapper to a neutral position, which, in turn, will cause the spool to return to a neutral position.

When it is desired to move piston 125 of fluid motor 124 to the right in FIG. 13, flapper 64 is moved to the left from a neutral position by the actuation of torque motor 51. This increases pressure at nozzle 40 while decreasing pressure at nozzle 39. The increase in pressure at nozzle 40 will cause an increase in pressure in conduit 131 and a corresponding increase in pressure in the left end 118 of spool chamber 29. There will also be a decrease in pressure in conduit 119 with a corresponding decrease in pressure in the right end portion 117 of spool chamber 29. This will cause a shift of spool 30 to the right as shown. Now there will be flow of fluid through supply port 72, valve conduit 75, and valve conduits 80 and 81. The flow from conduit 80 will enter spool notch 94 and pass through spool port 112 into the outer section 114 of filter chamber 116. The flow through conduit 81 will pass into spool notch 99 and then into valve conduit 130, bore 136, valve conduit 74, and conduit 129 to the left chamber 127 of motor 123. Part of the flow which enters bore 112 of spool 30 from annular notch 94 also passes through outer filter section 114 of spool chamber 116 and thence through spool bore 113 into notch 99 from which it flows through conduit 129 to motor chamber 127. Thus, there are two paths of flow from valve inlet conduit 75 to conduit 129 to accommodate relatively large flows. Simultaneously chamber 123 of motor 124 will be exhausted through conduit 122, control port 73, valve conduit 121, annular conduit 120, annular notch 95, return conduits 82 and 77, and return port 71. The fluid flow from the nozzle tips 45 and 47 is through the same path described above relative to FIG. 12 to return conduit 77. The action of feedback spring 68 is analogous to that described above relative to FIG. 12, except that it was originally flexed in the opposite direction.

It is to be especially noted that in the embodiments of FIGS. 1–13, the high pressure supply to motor 123 is always directly through one supply port 80 or 81 and indirectly through the other supply port because the fluid from the latter first passes through the outer filter chamber section 114 within spool 30. As noted above, the use of two supply ports will provide relatively large fluid flows, thereby in effect causing the valve 10 to have a greater capacity than if it had only flow through a single path.

In FIGS. 14, 15 and 16 an alternate embodiment of the present invention is disclosed wherein the high pressure flow to the motor 124 through servovalve 10 is only through a single path rather than a double path as described above. In this respect, the valve housing need not have an elongated inlet bore or conduit, such as 75, of the preceding figures leading to two valve conduits 80 and 81. It need merely lead to one such conduit, such as conduit 80. Otherwise, the structure is the same as in the preceding figures. The inlet port or conduit 71′ is in direct communication with valve conduit 80 which is in communication with the notch 94 of spool 30. At this point it is to be noted that when spool 30 is in the neutral centered position of FIG. 14, lands 91 and 92 will obstruct annular conduit 130 leading to control bore 74, and lands 85 and 87 will obstruct fluid annular conduit 120 (FIG. 6) leading to control port 73. Also, the return conduits 82 and 83 will be obstructed by the lands on spool 130. Since the annular conduits 120 and 130 leading to control bores 73 and 74 (FIG. 6), respectively, are closed off, and since the return conduits 82 and 83 are also closed off, the only flow will be from inlet supply bore 71', conduit 80 (FIG. 8), notch 94, and spool conduit 112 into inner filter chamber section 115 after passing through filter 104. Since conduits 120 and 130 are blocked off, there can be no flow out through spool port 113. Therefore, the flow from filter chamber 115 will be through the right end 117 and left end 118 of spool chamber 29 and thus through conduits 119 and 131 to nozzles 39 and 40, respectively, and then through bore 108, spool notch 67, and bore 126 (FIG. 6c) to return bore 77.

When it is desired to move piston 125 of fluid motor 124 to the right, as shown in FIG. 15, torque motor 51 is energized to move flapper 64 toward nozzle 40 and away from nozzle 39. This will cause the spool 30 to move to the right as shown in FIG. 15 because of the same fluid conditions described above relative to FIG. 12. More specifically, there will be an increase in pressure in end 118 of spool chamber 29 and a decrease in pressure in chamber 117 of spool chamber 29 because of the decreased flow through valve conduit 131 and the increased flow through valve conduit 119. At this point it is to be again noted that it is only the filtered fluid flowing through filter 104 which is applied against the flapper. After the spool has shifted to the position of FIG. 15, the fluid flow from inlet or supply conduit 71' will pass into a supply port, such as 72, valve conduit 80, spool notch 94, through spool bore 112, through outer filter section 114, through spool bore 113, through notch 99, and through valve conduits 130, conduit 136, and port 74 to conduit 129 leading to chamber 127 of motor 123. The exhaust from chamber 124 of motor 123 will be forced into conduit 122, through control port 73, valve conduit 121, valve conduit 120, spool notch 95, valve conduit 82, return conduit 77, and return port 71. As described above relative to FIG. 12, the feedback spring will return the spool 30 to a neutral position.

When it is desired to move piston 125 of motor 124 to the left in FIG. 16, torque motor 51 is energized to move flapper 64 to the right to thereby restrict flow from nozzle 39 while permitting increased flow from nozzle 40. As described above, this will result in an increase in pressure in end 117 of spool chamber 29 and in a decrease in pressure in end 118. Thus, flow of fluid into inlet or supply conduit 71' will be into a supply port, such as 72, valve conduit 80, notch 94, through spool port 112, and through filter 104 to conduits 119 and 131 leading to the nozzles 39 and 40, as described above relative to all of the embodiments. The flow to motor chamber 123 will be through spool notch 94, valve conduit 120, valve conduit 121, control port 73 and conduit 122. Fluid will be exhausted from motor chamber 127, through conduit 129, control port 74, valve conduits 136 and 130, spool notch 97, valve conduit 83, return conduit 77, and valve port 71.

The difference between the embodiment of FIGS. 1–13 and the embodiment of FIGS. 14–16 is that in the former fluid is supplied to motor 124 through two spool notches, namely, notches 94 and 99 in both positions of the spool, as can be seen from FIGS. 12 and 13 and as described above. However, in the embodiment of FIGS. 14–16, the fluid is essentially supplied through only one spool notch, either directly through notch 94 in the position of FIG. 16 or through notch 94, outer filter chamber 114 and notch 99, as shown in FIG. 15. This construction eliminates the need for a bore, such as 75 of FIG. 8.

As noted above, the main advantage of all of the embodiments of the present invention is that the fluid filter is located within a chamber in spool 30 rather than in a separate chamber as in proper devices. This permits the valve body to be made considerably smaller and also under certain circumstances permits the spool itself to be placed in a larger bore so that it can operate effectively at lower pressures because its ends have larger surface areas than spools which are placed in spool housings of the same size having a separate filter chamber. In addition, in the embodiment of FIGS. 1–13 there are two paths of inlet flow through the valve, which in effect causes the valve to have a greater flow capacity than if there were only a single flow path.

It can thus be seen that the improved servovalve of the present invention is manifestly capable of achieving the above enumerated objects and while preferred embodiments of the present invention have been disclosed, it will be appreciated that it is not limited thereto but may be otherwise embodied within the scope of the following claims.

What is claimed is:

1. A servovalve comprising a valve housing, a motor mounted on said valve housing, a flapper coupled to said motor, a flapper bore in said valve housing containing said flapper, a spool bore in said valve housing, a spool in said spool bore, first and second opposite ends on said spool, a fluid supply conduit in said valve housing, an elongated fluid supply bore in said valve housing extending substantially parallel to said spool bore and in communication with said fluid supply conduit, first and second spaced first conduits in said valve housing for effecting communication between said elongated fluid supply bore and said spool bore, a fluid return conduit in said valve housing, an elongated fluid return bore in said valve housing in communication with said fluid return conduit and extending substantially parallel to said spool bore and said supply bore, first and second spaced second conduits in said valve housing for effecting communication between said elongated fluid return bore and said spool bore, first and second spaced annular grooves formed directly in said valve housing and surrounding said spool bore and in communication therewith along substantial circumferential portions of said spool bore, first and second control conduits in said valve housing in communication with said first and second spaced annular grooves, respectively, first and second spaced lands on said spool for obstructing flow from said first and second spaced annular grooves into said spool bore when said spool is in a neutral position, a third land on said spool spaced outwardly from said first land for defining a first spool groove therewith, a fourth land on said spool spaced outwardly from said second land for defining a second spool groove therewith, an elongated filter chamber in said spool, an elongated hollow filter extending substantially coaxially with said spool bore and dividing said spool chamber into an outer annular filter chamber and an inner filter chamber, first and second spaced bores extending radially inwardly into said spool and in communication with said first and second spool grooves, respectively, for effecting communication between said supply conduit and said outer annular filter chamber through said first and second spaced first conduits and through said first and second spool grooves and said first and second spaced annular grooves, said inner filter chamber being in communication with said outer filter chamber through said filter, first and second annular orifice adapters on said first and second opposite ends of said spool, respectively, means mounting said opposite ends of said elongated hollow substantially cylindrical filter on said first and second orifice adapters to locate said filter within said spool bore and define said inner and outer filter chambers, first and second orifices in said first and second annular adapters, respectively, first and second spool bore chambers in said spool bore on the opposite sides of said first and second orifice adapters, respectively, from said filter chamber and in communication with said inner filter chamber through said first and second orifices, respectively, first and second nozzle bores in said valve housing, first and second nozzles in said first and second nozzle bores, respectively, on opposite sides of said flapper for directing fluid to opposite sides thereof, first and second nozzle fluid supply bores of substantially equal length in said valve housing and located on opposite sides of said flapper for effecting communication between said first and second spool bore chambers and said first and second nozzle bores, respectively, fifth and sixth lands on said spool located centrally between said first and second lands, a third spool groove between said fifth and sixth lands, a feedback spring forming an extension of said flapper, an end on said feedback spring, means locating said end of said feedback spring between said fifth and sixth lands for movement with said spool, a first nozzle fluid return bore in said valve housing for effecting communication between said flapper bore and said third spool groove, a second nozzle fluid return bore in said valve housing for effecting communication between said third spool groove and said elongated fluid return bore, a fourth spool groove between said first land and said fifth land, a fifth spool groove between said second land and said sixth land, said first and second spaced first conduits being located in communication with said first and second spool grooves, respectively, and said first and second spaced second conduits being located in communication with said fourth and fifth spool grooves, respectively.

2. A servovalve as set forth in claim 1 wherein said spool is symmetrical about a plane extending perpendicularly to the longitudinal axis thereof and located midway between said fifth and sixth lands.

3. A servovalve as set forth in claim 2 wherein said first and second spaced first conduits are equidistantly spaced from said plane when said spool is in said neutral position.

4. A servovalve as set forth in claim 3 wherein said first and second spaced second conduits are equidistantly spaced from said plane when said spool is in said neutral position.

5. A servovalve comprising a valve housing, a motor mounted on said valve housing, a flapper coupled to said motor, a flapper bore in said valve housing containing said flapper, a spool bore in said valve housing, a spool in said spool bore, first and second opposite ends on said spool, fluid supply conduit means in said valve housing for effecting communication with said spool bore for conducting fluid thereto, first and second spaced fluid return conduit means in said valve housing for effecting communication with said spool bore for conducting fluid therefrom, first and second spaced annular grooves formed directly in said valve housing and surrounding said spool bore and in communication therewith along substantial circumferential portions of said spool bore, first and second control conduits in said valve housing in communication with said first and second spaced annular grooves, respectively, first and second spaced lands on said spool for obstructing flow from said first and second spaced annular grooves into said spool bore when said spool is in a neutral position, a third land on said spool bores of substantially equal length in said valve housing and located on opposite sides of said flapper for effecting communication between said first and second spool bore chambers and said first and second nozzle bores, respectively, fifth and sixth lands on said spool located centrally between said first and second lands, a third spool groove between said fifth and sixth lands, a feedback spring forming an extension of said flapper, an end on said feedback spring, means locating said end of said feedback spring between said fifth and sixth lands for movement with said spool, a first nozzle fluid return bore in said valve housing for effecting communication between said flapper bore and said third spool groove, a second nozzle fluid return bore in said valve housing for effecting communication between said third spool groove and said fluid return conduit means, a fourth spool groove between said first land and said fifth land, a fifth spool groove between said second land and said sixth land, said fluid supply conduit means being located in communication with one of said first and second spool grooves directly and with the other of said first and second spool grooves through said outer filter chamber, and said first and second spaced fluid return conduit means being located in communication with said fourth and fifth spool grooves, respectively.

6. A servovalve as set forth in claim 5 wherein said fluid supply conduit means comprises a single conduit in communication with only one of said spaced annular grooves formed directly in said valve housing.

* * * * *

UNITED STATES PATENT AND TRADEMARK OFFICE

CERTIFICATE OF CORRECTION

PATENT NO. : 4,922,964

DATED : May 8, 1990

INVENTOR(S) : John H. Buscher

It is certified that error appears in the above-identified patent and that said Letters Patent is hereby corrected as shown below:

Column 10, line 23 (claim 5), after "spool" and before "bores", the following should be inserted:

--spaced outwardly from said first land for defining a first spool groove therewith, a fourth land on said spool spaced outwardly from said second land for defining a second spool groove therewith, an elongated filter chamber in said spool, an elongated hollow filter extending substantially coaxially with said spool bore and dividing said spool chamber into an outer annular filter chamber and an inner filter chamber, bore means extending radially inwardly into said spool and in communication with one of said first and second spool grooves, respectively, for effecting communication between said fluid supply conduit means and said outer annular filter chamber through said one of said spaced annular grooves and one of said first and second spool grooves, said inner filter chamber being in communication with said outer filter chamber through said filter, first and second annular orifice adapters on said first and second opposite ends of said spool, respectively, means mounting said opposite ends of said elongated hollow substantially cylindrical filter on said first and second orifice adapters to locate said filter within said spool bore and define said inner and outer filter chambers, first and

UNITED STATES PATENT AND TRADEMARK OFFICE

CERTIFICATE OF CORRECTION

PATENT NO. : 4,922,964

DATED : May 8, 1990

INVENTOR(S) : John H. Buscher

It is certified that error appears in the above-identified patent and that said Letters Patent is hereby corrected as shown below:

second orifices in said first and second annular adapters, respectively, first and second spool bore chambers in said spool bore on the opposite sides of said first and second orifice adapters, respectively, from said filter chamber and in communication with said inner filter chamber through said first and second orifices, respectively, first and second nozzle bores in said valve housing, first and second nozzles in said first and second nozzle bores, respectively, on opposite sides of said flapper for directing fluid to opposite sides thereof, first and second nozzle fluid supply--.

Signed and Sealed this

Sixteenth Day of July, 1991

*Attest:*

HARRY F. MANBECK, JR.

*Attesting Officer*

*Commissioner of Patents and Trademarks*